US005621280A

United States Patent [19]

Antonis et al.

[11] Patent Number: 5,621,280

[45] Date of Patent: Apr. 15, 1997

[54] ILLUMINATION UNIT, AND ELECTRODELESS LOW-PRESSURE DISCHARGE LAMP AND COIL SUITABLE FOR USE THEREIN

[75] Inventors: Petrus H. Antonis, Eindhoven, Netherlands; Jacob Schlejen, Morgantown, W. Va.; Leonardus U. E. Konings, Eindhoven, Netherlands

[73] Assignee: U.S. Philips Corporation, New York, N.Y.

[21] Appl. No.: 532,029

[22] Filed: Sep. 21, 1995

Related U.S. Application Data

[63] Continuation of Ser. No. 138,948, Oct. 18, 1993, abandoned.

[30] Foreign Application Priority Data

Oct. 21, 1992 [EP] European Pat. Off. ..... 92203223

[51] Int. Cl.[6] ..... H05B 41/16

[52] U.S. Cl. ..... 315/248; 315/278; 315/224; 336/224

[58] Field of Search ..... 315/248, 276, 315/278; 336/224

[56] References Cited

U.S. PATENT DOCUMENTS

| | | | |
|---|---|---|---|
| 3,748,510 | 7/1973 | McNeal | 310/71 |
| 4,562,384 | 12/1985 | Owen | 315/278 |
| 4,704,562 | 11/1987 | Postma et al. | 315/248 |
| 4,710,678 | 12/1987 | Houkes et al. | 315/248 |
| 5,061,896 | 10/1991 | Schmidt | 336/224 |
| 5,291,091 | 3/1994 | Eggink | 315/248 |
| 5,465,028 | 11/1995 | Antonis et al. | 315/248 |

FOREIGN PATENT DOCUMENTS 0162504 11/1985 European Pat. Off. .

*Primary Examiner*—Robert Pascal
*Assistant Examiner*—Darius Gambino
*Attorney, Agent, or Firm*—Walter M. Egbert, III; Bernard Franzblau

[57] ABSTRACT

An illumination unit comprises an electrodeless low-pressure discharge-lamp and a high-frequency power supply unit. The lamp has a gastight closed discharge vessel with an ionizable fill and a coil with turns of a primary and a secondary winding around a core of soft-magnetic material. The power supply unit has input terminals, a first output terminal, electrically neutral with respect to ground, that is connected to a first end of the primary winding, and a further output terminal that is connected to a second end of the primary winding. During nominal lamp operation the primary winding excites a high-frequency magnetic field that maintains an electrical discharge in the discharge vessel and that induces in the secondary winding a potential drop in the direction of a first, with respect to the electrically neutral end, to a second free end that varies in a sense opposite to the potential drop from the first to the second end in the first winding. At least one of the windings has at its second end at least one turn that extends beyond the core, which facilitates the ignition of the lamp.

17 Claims, 2 Drawing Sheets

ILLUMINATION UNIT, AND ELECTRODELESS LOW-PRESSURE DISCHARGE LAMP AND COIL SUITABLE FOR USE THEREIN

This is a continuation of application Ser. No. 08/138,948, filed on Oct. 18, 1993, now abandoned.

CROSS REFERENCE TO RELATED APPLICATION

This application relates to U.S. application Ser. No. 08/138,946 of Petrus H. Antonis et al, filed simultaneously herewith.

BACKGROUND OF THE INVENTION

The invention relates to an illumination unit comprising an electrodeless low-pressure discharge lamp and a high-frequency electric supply device, which lamp is provided with a discharge vessel sealed in a gaslight manner and containing an ionizable filling and with a coil comprising turns of a primary winding and of a secondary winding around a core of soft magnetic material, which supply device is provided with input terminals, with an output terminal which is electrically neutral with respect to mass and which is connected to a first end of the primary winding, and with a further output terminal which is connected to a second end of the primary winding, a high-frequency magnetic field being generated by the primary winding in a nominal operating condition, which field maintains an electric discharge in the discharge vessel and induces a potential gradient in the secondary winding in a direction from a first end which is electrically neutral with respect to ground to a second, free end, which gradient is oppositely directed to the potential gradient from the first to the second end in the primary winding.

The invention also relates to an electrodeless low-pressure discharge lamp suitable for use in the illumination unit.

The invention also relates to a coil suitable for use in the illumination unit.

Such an illumination unit is known from EP 0.162.504 A1. In the known illumination unit, the supply device is accommodated in a housing fastened to the discharge vessel of the lamp. The discharge vessel has a luminescent layer at the inside and is provided with a filling comprising mercury. The coil has 13 turns in a primary winding over a length of 25 mm and 14.5 turns in a secondary winding over a length of 30 mm around a core of 50 mm length. The first end of the secondary winding is connected to the neutral output terminal of the supply device, as is the first end of the primary winding.

A potential distribution across the coil resulting from the potential gradient occurring in each of the windings causes an electric field which is of importance for lamp ignition.

The asymmetrical supply device used in the illumination unit, where one of the terminals has a potential which at least substantially corresponds to ground and the other has a potential different therefrom, may be comparatively simple compared with a symmetrical supply device, i.e. a supply device with connection terminals which have mutually opposite potentials with respect to ground.

Although an asymmetrical supply device is used in the known illumination unit, the presence of the secondary winding results in a potential distribution across the coil which is at least substantially balanced relative to ground, so that the average potential over the coil surface is approximately equal to that of ground. Interference effects in the mains and in the environment have been limited to an acceptable level thereby.

A disadvantage of the known lamp is that it ignites with comparatively great difficulty compared with a lamp provided with a coil with a single winding. To have the lamp ignite quickly in spite of this, a comparatively high ignition voltage is required. This makes it necessary to use comparatively expensive components.

SUMMARY OF THE INVENTION

It is an object of the invention to provide an illumination unit of the kind described in the opening paragraph in which the lamp ignites comparatively easily and which nevertheless causes comparatively little interference. A further object of the invention is to provide an electrodeless low-pressure discharge lamp suitable for use in such an illumination unit. A still further object of the invention is to provide a coil suitable for use in the illumination unit.

According to the invention, the illumination unit is for this purpose characterized in that at least one of the windings at the second end comprises at least one turn which extends to beyond the core. The inventors have found that the lamp according to the invention ignites at a comparatively low ignition voltage within a preset time.

The coil may be positioned, for example, in the atmosphere of the discharge vessel, but preferably it is accommodated in a, for example, tubular recess of the discharge vessel. Lead-through constructions for the current supply conductors through the wall of the discharge vessel are then unnecessary.

The illumination unit according to the invention has, for example, a coil whose primary winding is wound, for example, with constant pitch and which has, for example, four turns which extend to beyond the core at the second end of this winding. The secondary winding lies, for example, against the primary winding over its entire length.

A preferred embodiment of the illumination unit according to the invention is characterized in that the length $L^S$ of the coil is at least three quarters of the length $L_k$ of the core. A further reduction in the ignition voltage is realized by this measure.

The use of an asymmetrical supply with the illumination unit according to the invention also leads to a potential distribution across the coil which is at least substantially balanced relative to ground, so that the illumination unit causes little interference in the environment and the mains compared with an illumination unit provided with a coil having a single winding. A further interference reduction is achieved in an attractive embodiment of the illumination unit according to the invention which is characterized in that turns around the core are distributed over segments which are situated at a distance from one another, and the number of turns of segments adjacent the second end which extends to beyond the core is comparatively great compared with segments remote from this second end. The segments comprise one or several turns. The segments are interconnected each time, for example, by a portion of a turn having a comparatively great pitch. Alternatively, for example, the segments may be interconnected by portions of the turn which extend parallel to the coil direction. Preferably, the distance between two consecutive segments is at least one third and at most two thirds of the overall length of these segments. This renders it possible to compensate variations in magnetic properties of the core which occur in practice through shifting of turns without an accompanying appreciable increase in interference.

A further interference reduction may also be obtained with a coil extending to beyond the core on one side in that the turn extending to beyond the core is wound with a pitch which decreases towards the second end.

Alternatively, the second end of the secondary winding may also extend to beyond the core at an opposing side. The turns then, for example, do not overlap or, for example, overlap only at portions adjoining the first ends.

Preferably, the coil is encapsulated in an elastic substance. The turns are then fixed in a simple manner.

BRIEF DESCRIPTION OF THE DRAWING

An embodiment of the illumination unit according to the invention will be explained in more detail with reference to the drawing, in which.

DESCRIPTION OF THE PREFERRED EMBODIMENTS

Figure 1:
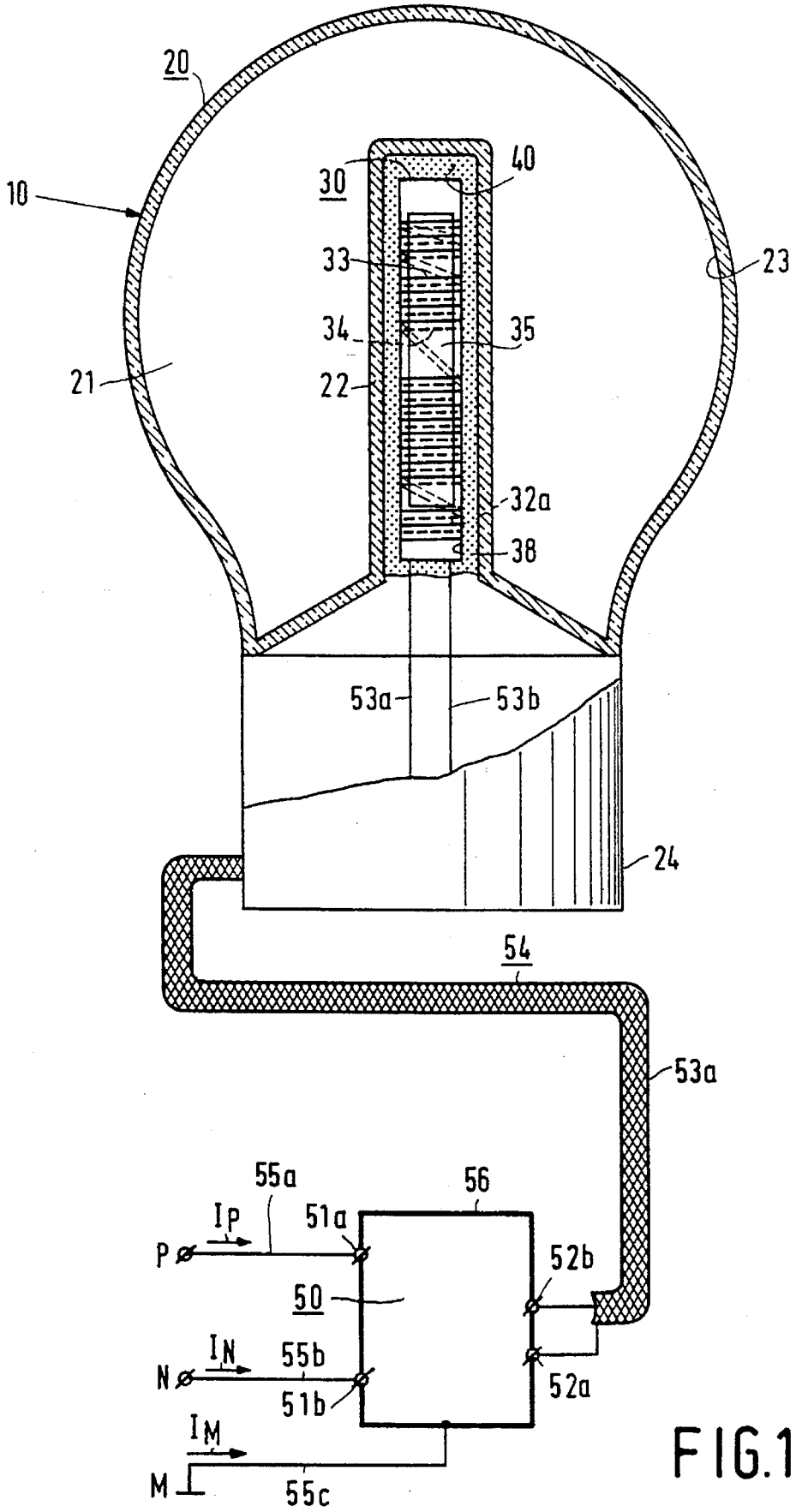
FIG. 1 shows a first embodiment in which the lamp is shown partly in side elevation and partly in longitudinal section, while the supply device is depicted diagrammatically.
Figure 2:
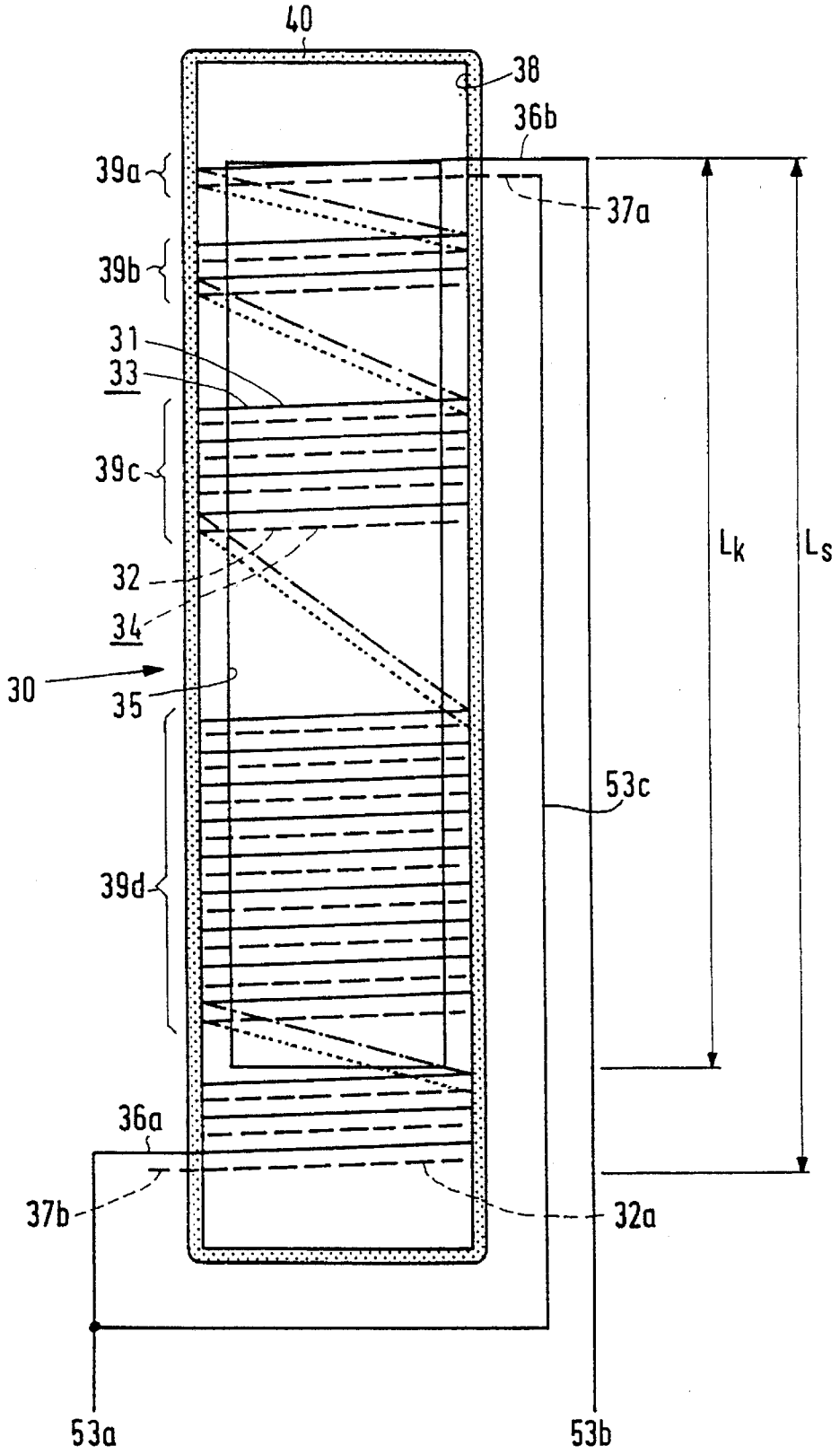
FIG. 2 shows components of the lamp of FIG. 1 in side elevation.

A first embodiment of the illumination unit according to the invention shown in FIG. 1 comprises an electrodeless low-pressure discharge lamp 10 and a supply device 50. The lamp 10 is provided with a pear-shaped discharge vessel 20 which is sealed in a gastight manner and has an ionizable filling 21 comprising 6 mg mercury and 180 mg of an amalgam of bismuth and indium in a weight ratio of 67:33. The filling 21 in addition comprises argon at a filling pressure of 33 Pa. The lamp 10 is also provided with a coil 30 having a length $L_s$ of 55 mm which is accommodated in a recess 22 of the discharge vessel. The coil 30, shown in more detail in FIG. 2, has 19 turns 31 of a primary winding 33 and also 19 turns 32 of a secondary winding 34 around a synthetic-resin coil former 38 which surrounds a core 35 of soft magnetic material. In this embodiment, the core 35 is a rod of Philips 4C6 ferrite with a diameter of 12 mm and a length of $L_K$, of 50 min. The primary winding 33 is indicated with a full line, the secondary winding 34 with a broken line. For greater clarity, only a few portions of turns extending behind the coil former are shown, and the coil former 38 is shown as transparent. The supply device 50 is provided with input terminals 51*a, b*. The supply device 50 is in addition provided with an output terminal 52*a* which is electrically neutral with respect to the ground M and which is connected to a first end 36*a* of the primary winding 33 via a current supply conductor 53, and provided with a further output terminal 52*b* which is connected to a second end 36*b* of the primary winding 33 via a current supply conductor 53*b*. Note that the first end of the primary winding 36*a* comprises at least one winding which extends beyond the adjacent end of the core. In a nominal operating condition, the primary winding 33 generates a high-frequency magnetic field which maintains an electric discharge in the discharge vessel 20. A potential gradient is induced in the secondary winding 34 in a direction from a first end 37*a* which is electrically neutral with respect to the ground M to a second, free end 37*b*, which gradient is oppositely directed to the potential gradient from the first to the second end 36*a*, 36*b* in the primary winding 33. The potential averaged over the surface of the coil 30 is approximately equal to that of the ground M. The first end 37*a* of the secondary winding 34 is electrically neutral because it is connected to the first end 36*a* of the primary winding via a current conductor 53*c*. Alternatively, for example, the first end 37*a* may to be connected to the ground M. The primary and the secondary winding 33, 34 are both made of insulated copper wire with a core thickness of 0.87 mm.

The secondary winding 34 has four turns 32*a* extending to beyond the core 35 at the second end 37*b*.

The length $L_s$ of the coil 30 is more than three quarters the length $L_k$ of the core 35.

The turns 31, 32 around the core 30 are distributed over four segments 39*a*, 39*b*, 39*c* and 39*d*. The segments 39*a–d* are interconnected by further portions of turns which run at a comparatively great pitch. Portions of turns of the primary winding 33 are indicated with dash-dot lines, portions of turns belonging to the secondary winding 34 with dotted lines. Segments 39*c,d* adjacent the second end 37*b* of the secondary winding 34 have more turns than segments 39*a,b* remote from the second end 37*b*. In this case the segments 39*a–d* have 1, 2, 4 and 9 turns, respectively. The respective lengths of the segments are 2, 3, 7 and 15 mm. The spacing (3 mm) between the first and the second segment 39*a*, 39*b* is more than one third and less than two thirds of the overall length (5 mm) of said segments 39*a,b*. Similarly, the spacing (6 mm) between the second and the third segment 39*b,c* is more than one third and less than two thirds of the overall length (10 mm) of said segments 39*b,c*. The spacing (10 mm) between the third and the fourth segment 39*c,d* is greater than one third and smaller than two thirds of the overall length (22 mm) of the third and fourth segment 39*c,d*.

The secondary winding 34 lies against the first winding 33 over its entire length. The windings 33, 34 are encapsulated in an elastic substance 40, in this case Q3-3600 silicone resin from Dow Corning.

The discharge vessel 20 is provided at its inner surface with a layer 23 of green-luminescing terbium-activated cerium-magnesium aluminate and red-luminescing yttrium oxide activated by trivalent europium. In an alternative embodiment of the illumination unit according to the invention, such a layer is absent and the discharge vessel has a filling comprising an amalgam of sodium and mercury. The discharge vessel 20 is fixed on a carrier 24 of synthetic material into whose interior a coaxial cable 54 is passed, which cable is connected to the supply device 50 and whose current supply conductors 53*a,b* form a sheath and a core, respectively. The supply device 50 is connected to connection terminals P, N of the mains by means of current conductors 55*a,b*. The supply device has a housing 56 which is connected to the ground M via a grounding line 55*c*. In a modified embodiment, the carrier is provided with a lamp cap at an end remote from the discharge vessel, for example, an Edison lamp cap in which lamp cap contacts are connected to a supply device incorporated in the carrier.

The supply device of the embodiment of the illumination unit according to the invention described with reference to the figures has a frequency of 2.65 MHz. The lamp consumes a power of 70W during nominal operation and has a light output of 5500 lm. The ignition voltage $V_{ign}$ of the lamp in this illumination unit was measured. The ignition voltage of an illumination unit not according to the invention was also measured. The coil of this latter illumination unit has a length $L_s$ of 32 mm and extends entirely between the ends of the core. The core has the same dimensions as the core of the illumination unit according to the invention. The windings of the former each have 15 turns, each of the turns of the secondary winding lying against a turn of the primary winding. An ignition pulse was offered every 2 s for measuring the ignition voltage. The voltage of the offered ignition pulses gradually decreased from 1300V to 400V during this measurement. The voltage $V_{ign}$ at which the lamp was still just capable of igniting is shown in the following Table for a pulse duration of 0.3, 2 and 10 ms, respectively.

Furthermore, the absolute value of the sum of the currents $I_P$ and $I_N$ through current conductors 55*a*, 55*b* was measured with a test loop. The absolute value of the total current $I_P+I_N+I_M$ through the current supply conductors 55*a*, 55*b* and the ground line 55*c* was also measured. The first value, indicated by $I_{asy}$ in the Table, is a measure of the influence of electric fields caused by the lamp on the mains. The second value, indicated by $I_{sur}$ in the Table, is a measure of the influence thereof on the surroundings. The relative value of the current compared with that of the illumination unit not according to the invention is indicated in parentheses.

| | $V_{ign}$ (V) 0.3 ms | $V_{ign}$ (V) 2 ms | $V_{ign}$ (V) 10 ms | $I_{asy}$ mA | $I_{sur}$ μA |
|---|---|---|---|---|---|
| lamp not acc. to the invent. | 858 | 647 | 578 | 4.4 (100%) | 594 (100%) |
| lamp acc. to the invent. | 666 | 497 | 438 | 3.8 (86%) | 267 (45%) |

The above Table shows that the lamp of the illumination unit according to the invention ignites comparatively easily. The influence on the mains of the electric field generated by the lamp during nominal operation is 14% less than that of the illumination unit not according to the invention. The influence on the surroundings is 55% less.

We claim:

1. An illumination unit, comprising:

an electrodeless low-pressure discharge lamp comprising a discharge vessel sealed in a gastight manner and containing an ionizable filling, a core of soft magnetic material extending longitudinally between respective ends of said core and a coil comprising turns of a primary winding and of a secondary winding, respectively around said core of soft magnetic material, said primary winding having a first end and a second end spaced from said first end along said core, and said secondary winding having a first end adjacent the second end of said primary winding and a second free end adjacent the first end of the primary winding; and a high frequency supply device comprising input terminals, an output terminal electrically neutral with respect to ground and connected to the first ends of the primary and of the secondary windings, and a further output terminal connected to the second end of the primary winding, a high-frequency magnetic field being generated by the primary winding in a nominal operating condition, which field maintains an electric discharge in the discharge vessel and induces a potential gradient in the secondary winding in a direction from the first end, which is electrically neutral with respect to ground, to the second, free end, which gradient is oppositely directed to the potential gradient from the first to the second end in the primary winding, and at least one of the windings at its second end comprises a turn which extends beyond the respective adjacent end of the core for facilitating lamp ignition.

2. An illumination unit as claimed in claim 1, wherein said core has a length $L_k$ and the coil has a length $L_s$ which is at least three quarters of the length $L_k$ of the core.

3. An illumination unit as claimed in claim 2, wherein turns around the core of a said winding are distributed over segments which are situated at a distance from one another, and the number of turns in segments adjacent the second end which extends beyond the core is comparatively great compared with segments remote from said second end.

4. An illumination unit as claimed in claim 3, characterized in that the distance between two consecutive segments remote from the second end is at least one third and at most two thirds of the combined length of these segments.

5. An illumination unit as claimed in claim 1, characterized in that the coil is encapsulated in an elastic substance.

6. An illumination unit as claimed in claim 1, wherein turns around the core are distributed over segments which are situated at a distance from one another, and the number of turns of segments adjacent the second end which extends beyond the core is comparatively great compared with segments remote from said second end.

7. An illumination unit as claimed in claim 6, wherein the distance between two consecutive segments is at least one third and at most two thirds of the combined length of these segments.

8. An illumination unit as claimed in claim 6, characterized in that the coil is encapsulated in an elastic substance.

9. An illumination unit as claimed in claim 2, wherein the coil is encapsulated in an elastic substance.

10. An illumination unit as claimed in claim 1, wherein the coil is encapsulated in an elastic substance.

11. An electrodeless low-pressure discharge lamp for connection to an asymmetrical high frequency supply having a first, neutral output terminal which is substantially neutral with respect to ground and a second output terminal at a potential different from ground, said lamp comprising:

a discharge vessel sealed in a gas-tight manner and containing an ionizable filling, a core of soft magnetic material extending longitudinally between respective ends thereof, and a coil comprising turns of a primary winding and of a secondary winding around said core of soft magnetic material, the primary winding having a first end for connection to the first, neutral output terminal of the supply device and a second end, spaced from the first end along said for connection to the second output terminal of the supply device, the secondary winding having a first end, adjacent said second end of the primary winding for connection to the first, neutral terminal of the supply device and a second, free end adjacent the first end of the primary winding, with the windings so connected to the supply device, a high-frequency magnetic field being generated by the primary winding in a nominal operating condition, which field maintains an electric discharge in the discharge vessel and induces a potential gradient in the secondary winding in a direction from the first end thereof, which is electrically neutral with respect to ground, to the second, free end thereof, which gradient is oppositely directed to the potential gradient from the first to the second end in the primary winding, and at least one of the windings at its second end comprises a turn which extends beyond the respective adjacent end of said core for facilitating lamp ignition.

12. An electrodeless low-pressure discharge lamp as claimed in claim 11, wherein the core has a length $L_k$, and the coil has a length $L_s$ which is at least three quarters of the length $L_k$ of the core.

13. An electrodeless low-pressure discharge lamp as claimed in claim 11, wherein turns around the core are distributed over segments which are situated at a distance from one another, and the number of turns of segments adjacent the second end which extends beyond the core is comparatively great compared with segments remote from said second end.

14. An electrodeless low-pressure discharge lamp as claimed in claim 11, wherein the distance between two consecutive segments is at least one third and at most two thirds of the combined length of these segments.

15. An electrodeless low-pressure discharge lamp as claimed in claim 11, wherein the coil is encapsulated in an elastic substance.

16. An electrodeless low-pressure discharge lamp as claimed in claim 11 wherein said at least one winding comprises the secondary winding.

17. An electrodeless low-pressure discharge lamp as claimed in claim 16 wherein said first end of the primary winding comprises at least one winding turn which extends beyond said respective adjacent end of said core.

* * * * *